United States Patent [19]

Kimble et al.

[11] 4,352,665

[45] Oct. 5, 1982

[54] SMALL ARMS LASER TRAINING DEVICE

[75] Inventors: Joe W. Kimble, Falls Church; Edsel E. Dotson, Alexandria, both of Va.

[73] Assignee: Cerberonics, Inc., Falls Church, Va.

[21] Appl. No.: 224,068

[22] Filed: Jan. 12, 1981

[51] Int. Cl.[3] ..... F41G 3/26

[52] U.S. Cl. ..... 434/22; 273/312

[58] Field of Search ..... 434/21, 22; 273/310, 273/311, 312

[56] References Cited

U.S. PATENT DOCUMENTS

| | | | |
|---|---|---|---|
| 3,220,732 | 11/1965 | Pincus | 273/312 |
| 3,335,934 | 8/1967 | Danis | 229/23 R |
| 3,404,305 | 10/1968 | Wright | 307/299 R X |
| 3,404,350 | 10/1968 | Muncheryan | 331/94.5 D |
| 3,447,033 | 5/1969 | Redmond et al. | 434/21 X |
| 3,454,898 | 7/1969 | Comstock | 331/94.5 Q |
| 3,478,278 | 11/1969 | Muncheryan | 331/94.5 D |
| 3,792,535 | 2/1974 | Marshall et al. | 434/22 |
| 3,964,178 | 6/1976 | Marshall et al. | 434/22 X |
| 3,995,376 | 12/1976 | Kimble et al. | 434/22 |
| 4,063,368 | 12/1977 | McFarland et al. | 434/22 |
| 4,083,560 | 4/1978 | Kikuchi et al. | 434/22 X |
| 4,102,059 | 7/1978 | Kimble et al. | 434/22 |
| 4,137,651 | 2/1979 | Pardes et al. | 434/22 X |
| 4,177,580 | 12/1979 | Marshall et al. | 434/22 |
| 4,195,422 | 4/1980 | Budmiger | 434/22 X |

*Primary Examiner*—William H. Greib

*Attorney, Agent, or Firm*—Gipple & Hale

[57] ABSTRACT

A weapon training simulation system comprising a firearm with a variable data transmission system mounted therein. The system includes at least one sensor to detect detonation of a blank round in the firearm, a variable data transmitter enabled by said sensor to transmit a signal comprising a weapon identification and, optionally, a direct hit/near miss selection, a power amplifier to amplify said signal, and a laser to project said amplified signal along the boresight of said firearm. The laser is mounted in the barrel of the firearm, and the other electronic components may be advantageously mounted in the handgrip or stock thereof. The system may include a firing counter to disable the transmitter once a number of transmissions equal to the number of rounds in a full load has been made. The system may also include a detector to disable the transmitter in the event that exterior sensors worn by the firearm user report that the user has been struck by laser light from a substantially identical system.

16 Claims, 10 Drawing Figures

+9v
R19
T1
D14
R14
R13
C12
450
LD1
R15
Q1
Q3
Q5
R17
C13
R18
Q4
Q2
480
400
500

Fig. 8
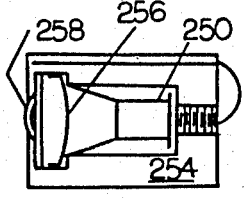
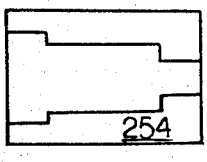
Fig. 7
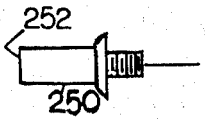
Fig. 6
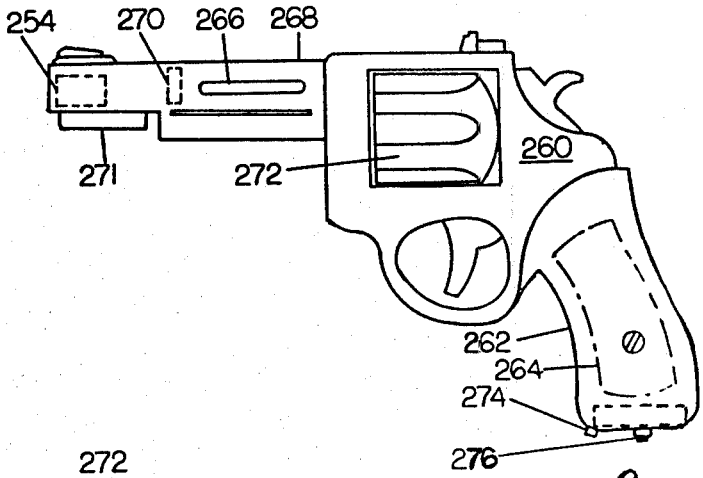
Fig. 9
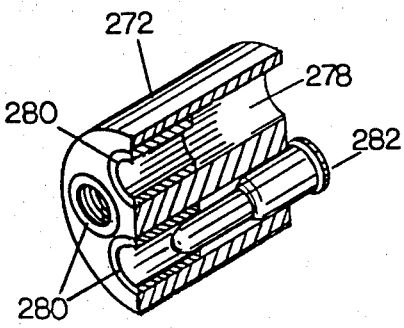
Fig. 10

SMALL ARMS LASER TRAINING DEVICE

BACKGROUND OF THE INVENTION

The present invention relates to a weapon utilized for marksmanship training and more particularly to a laser small arms firing system for use in training.

Several United States Patents have disclosed the use of a portable hand held weapon for actual combat use and for training purposes. U.S. Pat. No. 3,404,350 discloses a portable laser system placed in a pistol configured housing with an aiming telescope. The apparatus of this particular patent emits a laser beam which is powered from a battery located outside of the weapon housing. U.S. Pat. No. 3,335,934 also discloses the general concept of utilizing a laser in a pistol. U.S. Pat. Nos. 3,404,305; 3,454,898 and 3,478,278 disclose the use of lasers in connection with rifles or carbines.

A rifle training device is disclosed by U.S. Pat. No. 3,792,535. In this patent a cumbersome high voltage laser system including a transmitter, receiver and hit indicator is mounted to a rifle barrel. A retroflective means is provided in a target used with the rifle to indicate that the target has been hit with the laser beam.

Another U.S. Pat. No. 3,447,033 discloses a training device used on a tank in which a laser unit is mounted on the gun barrel of the tank with the power supply for firing the laser unit being contained in a housing which is mounted on the tank. The laser beam is fired at a target provided with a reflective surface which when hit by the laser beam produces a flash resembling that of a projectile hit.

It is also known in the art to use light beams in shooting galleries and other amusements areas to fire at darkened targets containing photosensitive cells. A typical such application is shown in U.S. Pat. No. 3,220,732 in which a strobe light with suitable optics is mounted in the barrel of a gun and is activated by a trigger switch which is connected to circuitry and a power source mounted in the barrel of the gun. In this patent, the target has a photoelectric cell mounted therein which is energized when impinged by a light source to activate a solenoid so that the target is displaced from its original position indicating that a hit has been scored.

While the above disclosed prior art does show the use of laser weapons and light sources for simulation of small arms firing, none of these weapons provides a safe realistic simulation of an actual firing of a weapon and quick determination of whether the target is hit.

U.S. Pat. Nos. 3,995,376 and 4,102,059 assigned to Cerberonics Inc. disclose a laser light source for simulation of arms firing which overcomes many of the these disadvantages. The patents disclose a miniaturized laser with optics mounted on the barrel of a weapon, with a detector unit mounted on a target. The power source and circuitry for the laser are contained within the weapon with no significant appearance or mass change in the original characteristics of the weapon. The laser-equipped weapon is fired in a conventional manner with either blank or live ammunition by squeezing off a shot while aiming at the target, which causes the laser to emit a harmless single pulse of coherent light. The frequency of the light is chosen to be invisible to human eyes, so that the human focus reflex which would otherwise concentrate the emitted light to burn out retina cells is not triggered should the laser strike any persons nearby. The pulse is aimed at the target and, if the target is hit, the detector unit receives and processes the pulse to cause an audible sound identifying that a hit has been registered. Thus both the weapons trainee and the instructor know when the weapon was fired accurately.

However, even this device is deficient in certain aspects relating to weapons fire simulation. The system disclosed makes no provision for discrimination between an accurate hit and a near miss, the latter of which is a useful diagnostic indicator in weapons training. Further, should the weapons training involve a group of competing or cooperating trainees firing at one or more common targets, there is no provision for target detection of which trainee from among the group has hit the target. Moreover, the device makes no provision for disabling the laser output when a number of shots corresponding to the ammunition available in the weapon has been fired.

A number of target systems have been disclosed in the prior art which discriminate between a hit and a near miss in simulated weapons fire. U.S. Pat. No. 4,083,560 discloses an array scanning system for determining the center of a laser radiation pattern striking a target composed of an array of photocells. Another such target system is disclosed in U.S. Pat. No. 4,177,580 and a third such system is disclosed in U.S. Pat. No. 4,195,422. U.S. Pat. No. 4,137,651 discloses a laser target system which includes an optical display on a reflective target screen. The screen image may be projected by motion picture projectors, and the simulated weapons fire is directed at the screen images to be reflected to a laser detector.

U.S. Pat. No. 4,063,368 discloses a weapons simulation system including a laser transmitter and detector. The laser transmitter is triggered by firing the weapon to which it is attached and weapon identification data is then transmitted by a plurality of laser diodes. The resulting beams are directed to project an overlapping pattern at the proximate distance of the target. The detection system mounted on the target need not include an array of photocells but does incorporate decoding means for determining the identity of the weapon which has fired to strike the target. The detection system also determines which one or more of the four overlapping beams has struck the target. However, this device has several deficiencies which make it less than ideal for flexible weapons simulation. Firstly, the plurality of laser diodes on the weapon must be aligned precisely in order to allow the target to discriminate accurately between a hit and a near miss. Secondly, the use of so many laser diodes increases the mass and power requirements of the laser transmitter as a whole. Thirdly, since the overlap pattern of the laser pulses varies significantly depending on the distance of the target from the transmitter, the system's ability to accurately distinguish between a hit and a near miss will vary according to the distance between the weapon and the target.

Another known laser training system is used by the United States Army and manufactured by Xerox Corporation. This system is called MILES and stands for Multiple Integrated Laser Engagement System. The Miles transmitter which is mounted on the weapon sends a laser signal made up of words which in turn are made up of 11 bits. Each word contains six pulses and five empty bits. Transmitters designed for different weapons are coded differently to provide for a weapons hierarchy. The transmitter for the M16 rifle sends a message made up of four kill words followed by 128 near miss words. The 128 near miss are sent on the assumption that a soldier firing a weapon that is weaving back and forth over the target would probably achieve a near miss. Each kill word is made up of the 11 bits (11001000111), and each near miss word is made up of the 11 bits (110001000111). The messages are generated by an RCA CDP 1802 microprocessor with the program contained in a 512 word ROM programmed to represent the particular weapon desired. Decoding of the kill and near miss words is accomplished by the detector which contains shift registers and a custom made decoder chip. The MILES system requires a great deal of battery power for the microprocessor and ROM, and is too bulky to install in a handgun.

SUMMARY OF THE INVENTION

The present invention provides a highly realistic simulation of the use of small arms allowing law enforcement scenarios or war games exercises to be played out as the weapon can utilize normal blank ammunition. The blank ammunition is provided for any particular caliber of weapon and is fired to initiate the laser pulse which is simultaneously fired with the blank. Individuals or targets have a suitably configured detector mounted thereon so that an audible or visual signal is activated if the pulse strikes the sensor element. It should be particularly noted that one advantage of the present invention is that it can be used in artificial light or broad daylight without ambient light stimulation of the target sensor worn by the individual. A preferred embodiment of the present invention also includes means for disabling a weapon when its user has been "shot" as determined by a userworn detector system.

The weight of the invention is substantially identical with the original weight of factory small arms weapons so that the laser weight addition is negligible, with weapon overall balance being maintained along with original mechanical strength. The CMOS integrated circuit and pulse electronics of the laser consume little current so that the internally contained batteries have a long life.

The laser adapted weapon is completely portable and its circuits and power source are entirely housed within the weapon stock or butt grips. The laser unit is also easily adapted to any standard weapon.

The laser adapted weapon is designed to be used with blanks for "dry fire" exercise to reduce training costs. This capability allows the trainee to accurately detect the weapon's aiming point without firing a live round and increases his or her attention to the instructors. Thus, during the early training period the number of costly live rounds which would normally be fired to achieve a specified level of marksmanship are greatly decreased. Another cost factor which must be taken into account is the target costs for pop-up and other moving targets which remain undamaged with the present invention.

Since the power supply and circuitry are entirely contained in the weapon and the target detector can be carried on the individual who participates in the particular scenario or war game, realism is added to the exercise.

The laser pulse transmitted by the invention is encoded to identify the user to any appropriate detection system. The pulse may also be encoded to distinguish between light transmitted from a weapon as it is aimed and light transmitted after weapon movement in reaction to firing.

Thus, it can be seen that the function modularity, three dimensional mechanization, compact packaging, component selection, low power drain, light weight and performance meet all of the requirements for a low cost effective training weapon.

One of the dangers associated with laser implementation is possible eye damage including burns which can occur under collimated radiation from an intense point source. The present invention eliminates this problem via the low power and brief duration of the laser output and the optics employed to direct the beam. Thus the system avoids eye damage in a man-against-man combat scenario. Calculation of eye damage irradiance shows that this system is completely safe and that the threshold of eye damage can be approached only if the operator holds the laser optics directly in front of his eye and fires directly into the pupil.

The above-mentioned purposes and operations of the invention are more readily apparent when read in conjunction with the following description of the drawings and the detailed description of the preferred embodiment of the present invention.

BRIEF DESCRIPTION OF THE DRAWINGS

FIG. 3 is a circuit diagram of a gain controlled power amplifier and modulated laser output circuit;

FIG. 6 is a side view of a laser diode;

FIG. 7 is a cross-section view of a laser diode housing;

FIG. 8 is a cross-sectional view of a laser diode housing containing a laser diode and projection optics;

FIG. 9 is a side view of a handgun with installation of system components shown in phantom; and FIG. 10 is a perspective view partially in cut-away of a handgun cylinder adapted for use with the present invention.

DETAILED DESCRIPTION OF THE DRAWINGS

Figure 1:
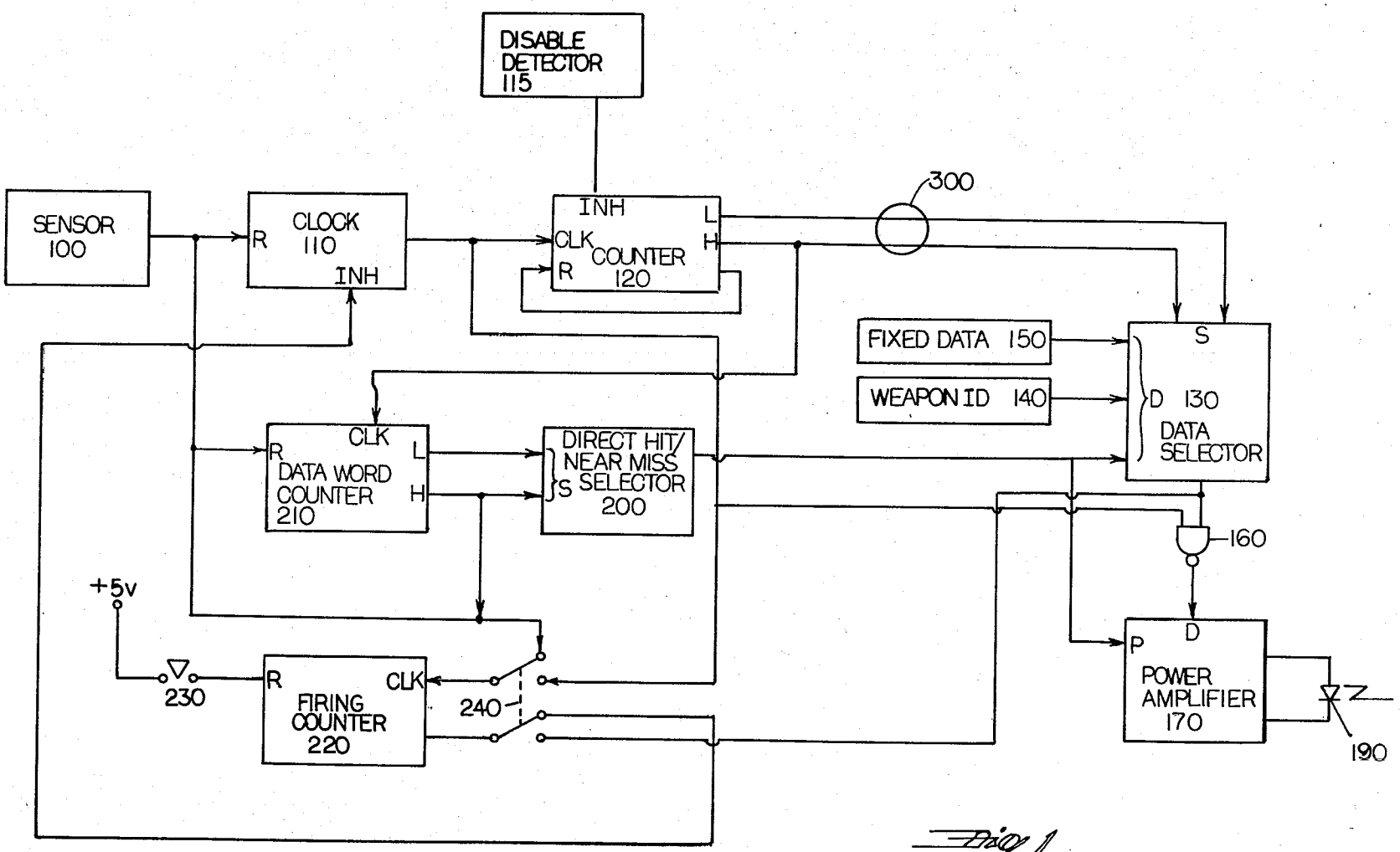
FIG. 1 is a block diagram of a laser transmission system according to the present invention.

The preferred embodiment and best mode of the invention is shown in FIG. 1. Turning first to FIG. 1, a block diagram of the preferred embodiment of the inventive apparatus is shown which includes a trigger sensor 100 for detecting the firing of a weapon by a trainee. Trigger sensor 100 may be of any conventional construction including electromechanical, electroptical or electroacoustic. Trigger sensor 100 is connected to clock 110 so that clock 110 is started when the trigger is released.

Clock 110 produces a fixed clock signal, preferably at a frequency of 6 kHz, and provides that signal to the input of counter 120. Disable detector 115 is coupled to an inhibit input of counter 120, and is adapted to disable the system when the user has been 37 shot" by a laser pulse. Counter 120 is of any well known type which represents the number of pulses received from a clock or other source by the binary status of a plurality of bit counter outputs. A plurality of such outputs are connected to data selector 130, and comprise bit select bus 300. Another one of such outputs is connected to the reset input of bit counter 120.

Data selector 130 includes a plurality of parallel data inputs comprising a data word, including weapon identification data 140, fixed data 150 and direct hit/near miss selector 200 data. The sequential counting pattern presented on the selector inputs by bit select bus 300 causes data selector 130 to transmit each of the data inputs in a sequential manner to one input of NAND gate 160. The second input of gate 160 receives the clock signal from clock 110. The output of gate 160 is coupled to the data input of power amplifier 170 and the output of direct hit/near miss selector 200 is also coupled to the gain control input of amplifier 170. The output of amplifier 170 drives laser diode 190 which produces light transmitted from the training weapon in the direction of simulated weapons fire.

The most significant bit of those which comprise bit select bus 300 is also connected to the counter output of data word counter 210. Data word counter 210 is reset by the activation of trigger sensor 100. Data word counter 210 then counts the number of times a data word is sent by the inventive apparatus to a receiver device. After a predetermined number of such data words approximately corresponding in duration to the time taken for a weapons projectile to travel to a target, a counter output of data word counter 210 activates kill/miss selector 200, which in turn changes the status of one or more bits transmitted sequentially by data selector 130. For the remainder of the transmission time, the data words transmitted will therefore indicate to any target which receives the transmission that a near miss has occurred. The most significant bit of data word counter 210 is coupled to the clock input of firing counter 220, and is also coupled to the reset of counter 210.

Firing counter 220 counts the number of times that the trigger has been pulled by the trainee. After a number of trigger pulls corresponding to the simulated ammunition load (round holding capacity) of the weapon, firing counter 220 inhibits clock 110 so that further trigger pulls will not send a laser message to any receivers. Firing counter 220 may be manually reset thereafter, simulating a reload of the weapon, by use of reset key 230. Reset key 230 typically is a security key held by the weapons instructor.

Switch 240 is a double-pole double-throw switch for selection of an alternate boresight mode of operation of the system, allowing continuous laser output for optical alignment purposes. Pole 1 connects either the output of counter 210 (firing mode) or of clock 110 (boresight mode) to the input of counter 220. Pole 2 either disconnects (firing) or connects (boresight) a predetermined divider output of counter 220 to the data input of amplifier 170.

Figure 2:
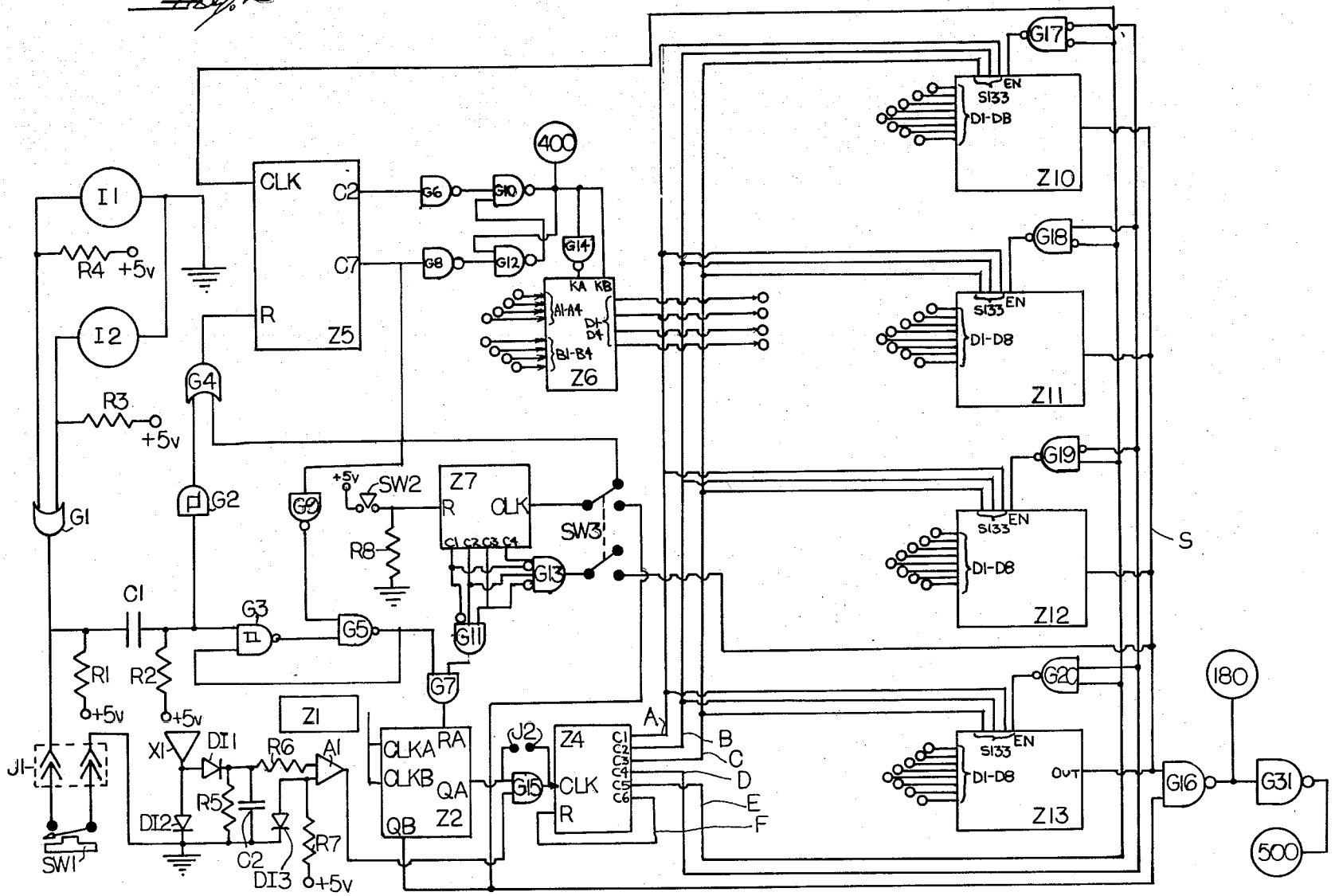
FIG. 2 is a circuit diagram of signal generating circuitry corresponding to a portion of the system of FIG. 1.

Turning now to FIG. 2, a circuit diagram corresponding to a portion of the block diagram shown in FIG. 1 is disclosed in which an optical sensor I1 and an accelerometer I2 are combined to detect the firing of a blank by the weapon. The output of the optical sensor I1 is coupled through resistor R4 to a 5 volt source so that the output is normally at a positive logic state. However, when the optical sensor detects firing of the weapon, the output falls to ground level. Similarly, the output of accelerometer I2 is coupled through resistor R3 to a 5 volt source, and will remain positive until acceleration is detected. The outputs of I1 and I2 are connected to OR gate G1 and the output of G1 will be positive unless both I1 and I2 detect a firing. Additionally, a remote triggering assembly may be connected through connector J1 to bring the output level to ground by closing double-pole single-throw switch SW1.

Capacitor C1 has one lead connected to the output of G1 and through resistor R1 to a 5 volt source, and the other lead connected through resistor R2 to a 5 volt source. Thus, before the sensors I1 and I2 are activated, the voltage on both leads of the capacitor C1 is 5 volts. When the sensors I1 and I2 detect a firing, or when switch SW1 is connected and closed, the voltage at the junction of capacitor C1 and resistor R2 falls to ground and then rises back to 5 volts as the capacitor C1 is charged. The junction of C1 and R2 is also connected to the input of buffer G2 and one input of NAND gate G3.

The output of gate G3 is connected to one input of NAND gate G5 and the output of G5 is connected to the second input of G3. Additionally, the output of G5 is coupled to one input of AND gate G7.

Integrated circuit Z1 is configured to oscillate, preferably at a frequency of 12 kHz. The output of integrated circuit Z1 is coupled to the clock inputs of integrated circuit Z2, which is a dual JK flipflop. These flipflops, referred to hereinafter as Z2A and Z2B, are operated in a clock mode with both J and K inputs tied to positive voltage. The output of gate G7 is coupled to the reset input of the flipflop Z2A. The Q outputs of Z2 presents a 6 kHz clock signal which drives the remainder of the system.

Integrated circuit Z4 is a binary counter corresponding to counter 120 of FIG. 1. The input of Z4 is coupled to the Q output of integrated circuit Z2A through AND gate G15. Lines A, B, C, D, E and F are coupled to outputs C1, C2, C3, C4, C5 and C6, respectively, of counter Z4. Line F is coupled to the reset input of Z4, so that when a total of 64 clock pulses have reached the counter, the counter will reset. Lines A through E correspond to the bit select bus 300 shown in FIG. 1.

Integrated circuits Z10, Z11, Z12 and Z13 are 8-bit data selectors which are operated serially in this embodiment to produce a 32-bit data word. Each such integrated circuit includes data inputs D1–D8, data select inputs S1–S3 for selection of one the eight data inputs to be transmitted, and a tri-state enable input EN which disconnects the output of the integrated circuit from the common output line S. Some of the inputs D1–D8 of each selector may be fixed at high or low values in order to facilitate data reception by an electronic target system. Others may be set to high or low values individually in order to encode a weapon identification number in the transmitted laser signal. Moreover, still other inputs may be toggled by outputs of integrated circuit Z6 to distinguish between a hit and a near miss as will be described more fully hereinbelow.

Decoding gates G17, G18, G19 and G20 are coupled to the tri-state enable inputs of integrated circuits Z10, Z11, Z12 and Z13 respectively. The inputs of G17, G18, G19 and G20 are each coupled to lines D and E and each gate is uniquely configured to disconnect the output of its corresponding data selector when another data selector is transmitting its data inputs. Thus, when lines D and E are both low, Z10 will transmit while Z11, Z12 and Z13 are disconnected. When line E is high and D is low, Z11 will transmit while Z10, Z12 and Z13 are disconnected. When E is high and D is low, Z12 will transmit while Z10, Z11 and Z13 are disconnected. Finally, when both D and E are high, Z13 will transmit while Z10, Z11 and Z12 are disconnected. It can be seen that while the status of lines A, B and C presents a binary count from zero through 7 on the data selector inputs of Z10, Z11, Z12 and Z13, thereby simultaneously polling data inputs D1 through D8 of each of the data selectors, only one of the data selectors will be connected to line S to serially transmit all eight polled inputs. Thereafter, the polling is repeated and the next data selector is connected to line S for transmission. In this manner, a 32-bit data selector is advantageously and economically constructed corresponding to data selector 130 illustrated in FIG. 1.

Line E is also coupled to the clock input of integrated circuit Z5 which is a binary counter corresponding to the data word counter 210 illustrated in FIG. 2. Z5 counts the number of 32-bit data words which have been transmitted by data selector 130. Counter output C7 of Z5, which goes positive when 128 data words have been transmitted, is connected to one input of OR gate G4, and the second input of G4 is connected to the output of buffer G2. The output of OR gate G4 is connected to the reset input of Z5. Thus the counter outputs of Z5 are reset to zero when either 128 data words have been transmitted or the transmitter is retriggered.

Output C7 of Z5 is also connected to the input of inverter G8. Output C2 of integrated circuit Z5, which goes positive when 4 data words have been transmitted is connected to the input of inverter G6. The outputs of inverters G8 and G6 are connected to inputs of NAND gates G12 and G10, respectively. The second input of NAND gate G10 is connected to the output of G12 and the second input of G12 is connected to the output of G10. Thus, NAND gates G10 and G12 form a set-reset flipflop. The output of NAND gate G10 is also connected to input KB of integrated circuit Z6, and through inverter G14 to input KA of Z6. Integrated circuit Z6 is a four-pole double-throw data selector, and the status of the set-reset flipflop formed by NAND gates G10 and G12 will select either inputs A1–A4 or B1–B4 to be connected to the four output pins D1–D4 of Z6. The inputs A1 through A4 are connected to the outputs of Z6 whenever C7 of Z5 goes high, and will remain connected to the outputs of Z6 until C2 of Z5 goes high. When that occurs, the inputs B1 through B4 of Z6 will be connected to the outputs of Z6 until C7 of Z5 goes high.

Integrated circuit Z5 corresponds to data word counter 210 illustrated in FIG. 1, and integrated circuit Z6 and components connected between circuits Z5 and Z6 comprise direct hit/near miss selector 200. Z6 inputs A1–A4 may be coupled to ground or positive voltage in a pattern differing from the connection pattern of Z6 inputs B1–B4, and Z6 outputs D1–D4 may be coupled to any inputs D1–D8 of data selectors Z10–Z13 for inclusion of dynamic data indicating a "direct hit" or a "near miss". The status of these bits can be recognized by an appropriate laser receiver and decoding system to indicate that the target has been illuminated by the appropriate signal. As illustrated, the system will transmit four "direct hit" words, followed by one hundred and twenty four "near miss" words, although it should be obvious to those of ordinary skill in the art that the quantities of such data words transmitted may be varied by connection of appropriate decoding logic between the counter outputs of Z5 and the selector inputs KA and KB of Z6.

Counter output C7 of counter Z5 is also connected through inverter G9 to a second input of NAND gate G5 in order to reset flipflop Z2A, thereby inhibiting further laser output once 128 data words have been transmitted. The output then remains inhibited until the system is again triggered.

Integrated circuit Z7 is a binary counter corresponding to the firing counter 220 shown in FIG. 1. The clock input of Z7 is connected to one pole of double-pole double-throw switch SW3, and may be connected thereby to either counter output C7,Z5, corresponding to weapons simulation mode of the system, or to output Q,Z2B, corresponding to boresight operation mode of the system. In weapons simulation mode, counter Z7 counts the number of round fired by the trainee, and appropriate decoding logic is coupled to the counter outputs of Z7 in order to inhibit further use of the weapon after firing a number of rounds equal to the normal load of the weapon. As illustrated in FIG. 2, counter outputs C1 through C3 of Z7 are coupled to decoding gate G11, and the output of G11 is coupled through a second input of G7 to the reset input of Z2A. The illustrated configuration of G11 will inhibit firing of the weapon after six shots have been fired. Z7 may be reset to enable further firing by closure of switch SW2, which is typically a key switch possessed by the training instructor. The reset input of Z7 is coupled through resistor R7 to ground, and through SW2 when closed to a five volt source.

Counter outputs C1 through C4 of Z7 are also coupled to decoding gate G13, and the output of G13 is coupled through the second pole of switch SW3 to line S, corresponding to boresight mode, or is disconnected therefrom, corresponding to weapons simulation mode. As illustrated in FIG. 2, when SW3 selects the boresight mode, the Q output of Z2B is connected directly to the clock input of Z7, and the counter outputs of Z7 are decoded by G13 to divide the clock signal by a factor of 10. The resulting signal is fed directly to line S. Line S is coupled to one input of NAND gate G16, and the other input of G16 is coupled to the Q output of Z2B. The output of G16 is coupled to load line 480 and through inverter G31 to data line 500.

Antenna X1 is coupled through diode DI2 to ground and through diode DI1 and resistor R6 in series to one input of operational amplifier A1. The junction of diode DI1 and resistor R6 is also coupled through resistor R5 and capacitor C2 to ground. The second input of operational amplifier A1 is coupled through diode DI3 to ground, and through resistor R7 to a five volt source. The second input establishes a reference voltage. A1 compares the received signal with the reference voltage and provides an output only when the received signal level is greater than the reference voltage. The output of operational amplifier A1 is connected through a second input of gate G15 to the clock input of counter Z4. Antenna X1, operational amplifier A1 and components connected therebetween comprises a radio receiver corresponding to detector disable 115 as illustrated in FIG. 1. An appropriate laser detection target system worn by a weapons trainee may transmit an enable signal to detector disable 115 until such time as the target system detects that the trainee has been disabled by illumination from another weapons training system, at which time the status of gate G15 will change to disconnect the Q output of Z2A from the clock input of Z4. In the event that the training procedures do not include the wearing of a laser detection target system by each trainee, a connection across jumper J2 may be made in order to bypass detector disable 115.

FIG. 3 illustrates a logic-controlled power supply and driver circuit for the laser diode of the preferred embodiment. Line 480 is coupled to the base of transistor Q4, and the emitter of Q4 is coupled through resister R18 to ground. Line 400 is coupled to the base of transistor Q2, and the emitter and collector of Q2 are connected in parallel with R18. The collector of Q4 is coupled to an intermediate coil of transformer T1. One side tap of T1 is coupled directly to a nine volt source, and the other side tap is coupled through capacitor C12 and resistor R14 to ground.

The connection point of the collector of Q4 to T1 is chosen so that pulses from line 480 multiply the nine volts supplied and charge C12 therewith.

Thus, a power supply voltage is produced well in excess of that possible by directly tapping a battery small enough to fit within a firearm. Line 450 is directly coupled to the emitter of transistor Q1 and is coupled through resistor R13 to the base of transistor Q1. The base of transistor Q1 is also coupled to line 500. The collector of transistor Q1 is coupled directly to the base of transistor Q3 and the collector of transistor Q3 is coupled through resistor R15 to line 450. The collector of transistor Q3 is also coupled through capacitor C13 to ground. The emitter of transistor Q3 is coupled through resistor R17 to ground as well as directly to the base of transistor Q5. The cathode of laser diode LD1 is connected to the collector of transistor Q5 and the anode of laser diode LD1 is connected to line 450. The emitter of transistor Q5 is connected directly to ground.

In operation, the output pulses which form the 32 bit data word arrive in serial order on line 500 and are coupled to the base of transistor Q1, which transistor acts as an inverter-switch to drive the transistors Q3 and Q5 into conduction. Capacitor C13 establishes the final output pulse width of each data bit in the laser transmission. When transistor Q5 is biased on by the pulse, it draws approximately 15 ampere current pulse for 200 nanoseconds through the laser diode LD1. The laser diode LD1 radiates a coherent light burst at 904 nanometers wavelength for the duration of each encoded pulse. When current is supplied to the base of transistor Q2, resistor R18 is short-circuited, and removed from the circuit. This allows increased power to be delivered to the laser diode LD1. When no current is supplied to the base of transistor Q2, the collector and emitter of transistor Q2 are effectively disconnected from one another and all current passing through the primary of transformer T1 must also pass through resistor R18.

In operation of the preferred embodiment by a weapons trainee, connector J1 is disconnected, switch SW2 is opened and switch SW3 is set as illustrated in FIG. 2. When the discharge of a blank round is detected by sensors I1 and I2, counter Z5 is reset and the Q output of Z2A is enabled. If operational amplifier A1 provides a signal to G15 indicating that the trainee has not yet been disabled, then the output of Z2A is connected to the clock input of Z4. The counter outputs of Z4 poll the 32 data inputs of Z10, Z11, Z12 and Z13, and each group of 32 bits transmitted increments the clock input of counter Z5. At least one of the four output bits D1 through D4 of data selector Z6 is coupled to one of the 32 data inputs of the data selectors Z10 through Z13. During the first four 32-bit words transmitted, inputs A1 through A4 of Z6 are coupled to output D1 through D4 so that "direct hit" words are input 400 of the power amplifier and laser diode illustrated in FIG. 3 is set for low power transmission. When four data words have been transmitted, counter output C2 of Z5 goes high, forcing Z6 to connect inputs B1 through B4 to outputs D1 through D4. Also, power control 400 is set to high power transmission. The system will then transmit "near miss" words until 128 total words have been transmitted. At that point, counter output C7 of Z5 will go positive, resetting Z2 to discontinue transmission and incrementing counter Z7 to count the number of training rounds expended. When six rounds have been expended, the decoding gate G11 will reset Z2 preventing further use of the weapon until counter Z7 is reset through closure of switch SW2 by the training instructor.

Figure 4:
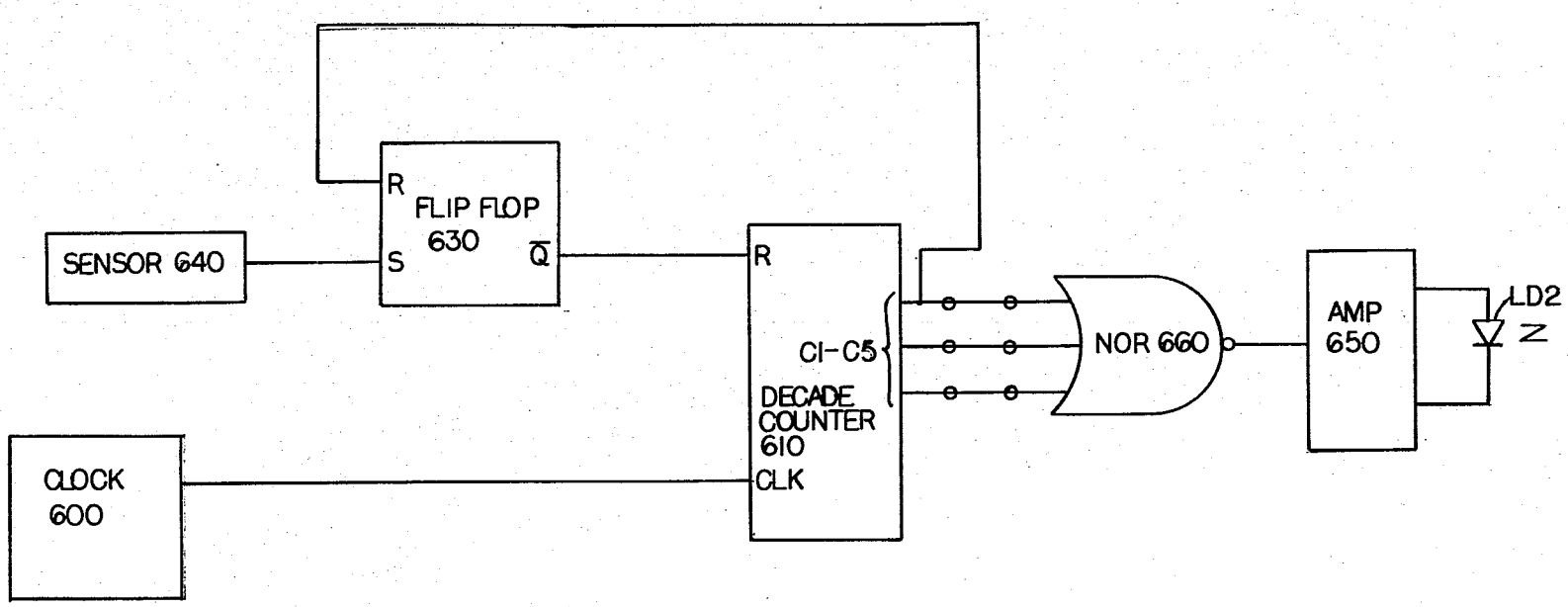
FIG. 4 is a block diagram of an alternate laser transmission system.
Figure 5:
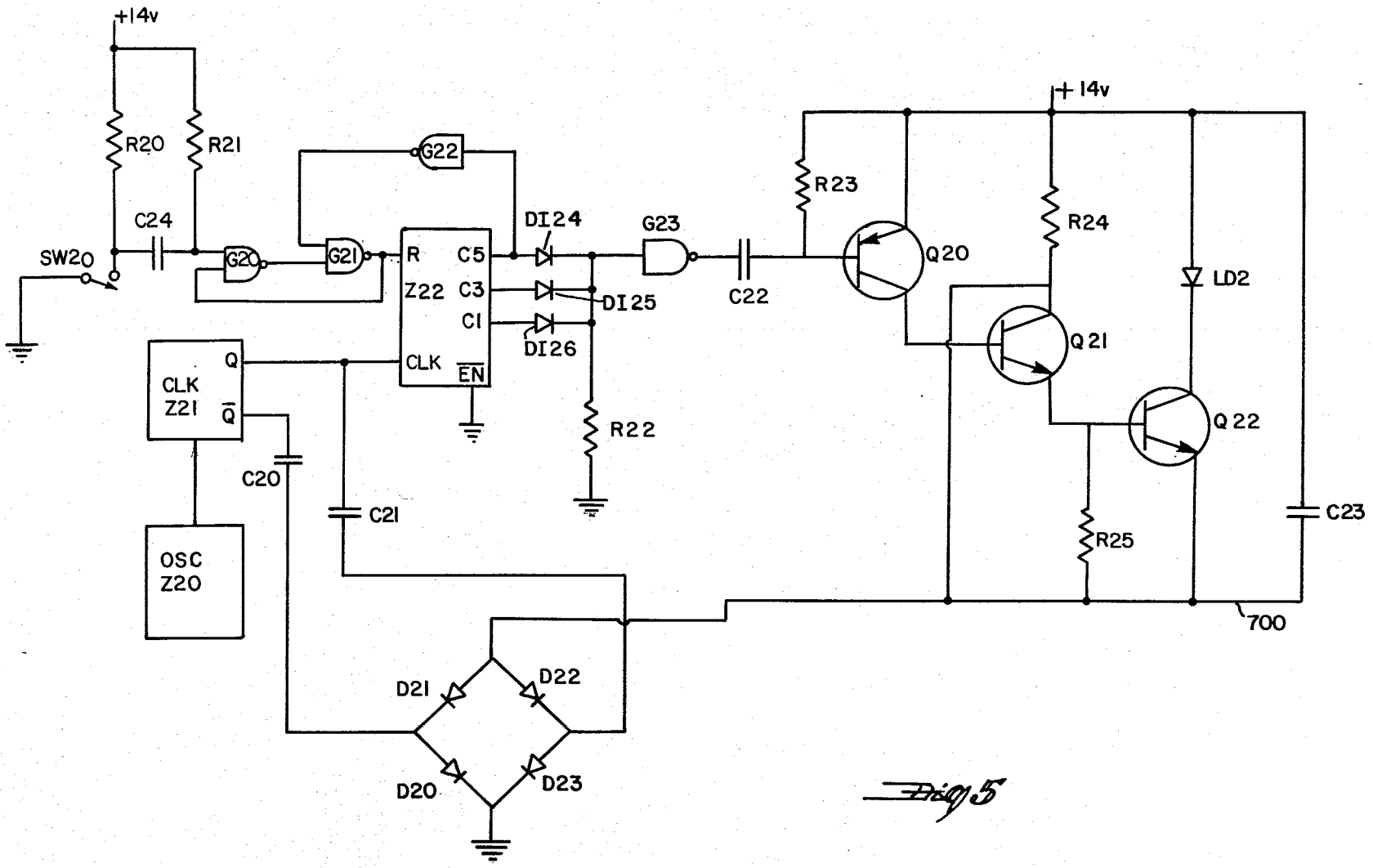

FIG. 4 is a block diagram illustrating an alternative economy embodiment of the invention. Sensor 640 is connected to the set input of flipflop 630, and the inverted Q output of flipflop 630 is coupled to the reset input of decade counter 610. The output of clock 600 is connected to the clock input of decade counter 610, and the counter outputs C1 through C5 of decade counter 610 may be selectively coupled to the inputs of multiple NOR gate 660 to determine the output bit pattern of the laser transmission. Thus, the alternative economy embodiment transmits a 5-bit data word identifying the weapon being fired. Output C5 of counter 610 is also coupled to the reset input of flipflop 630 in order to clear the outputs of counter 610 and end transmission until sensor 640 detects another firing of the weapon and sets flipflop 630. The output of NOR gate 660 is coupled to the data input of power amplifier 650, and power amplifier 650 drives laser diode LD2.

Figure 5:
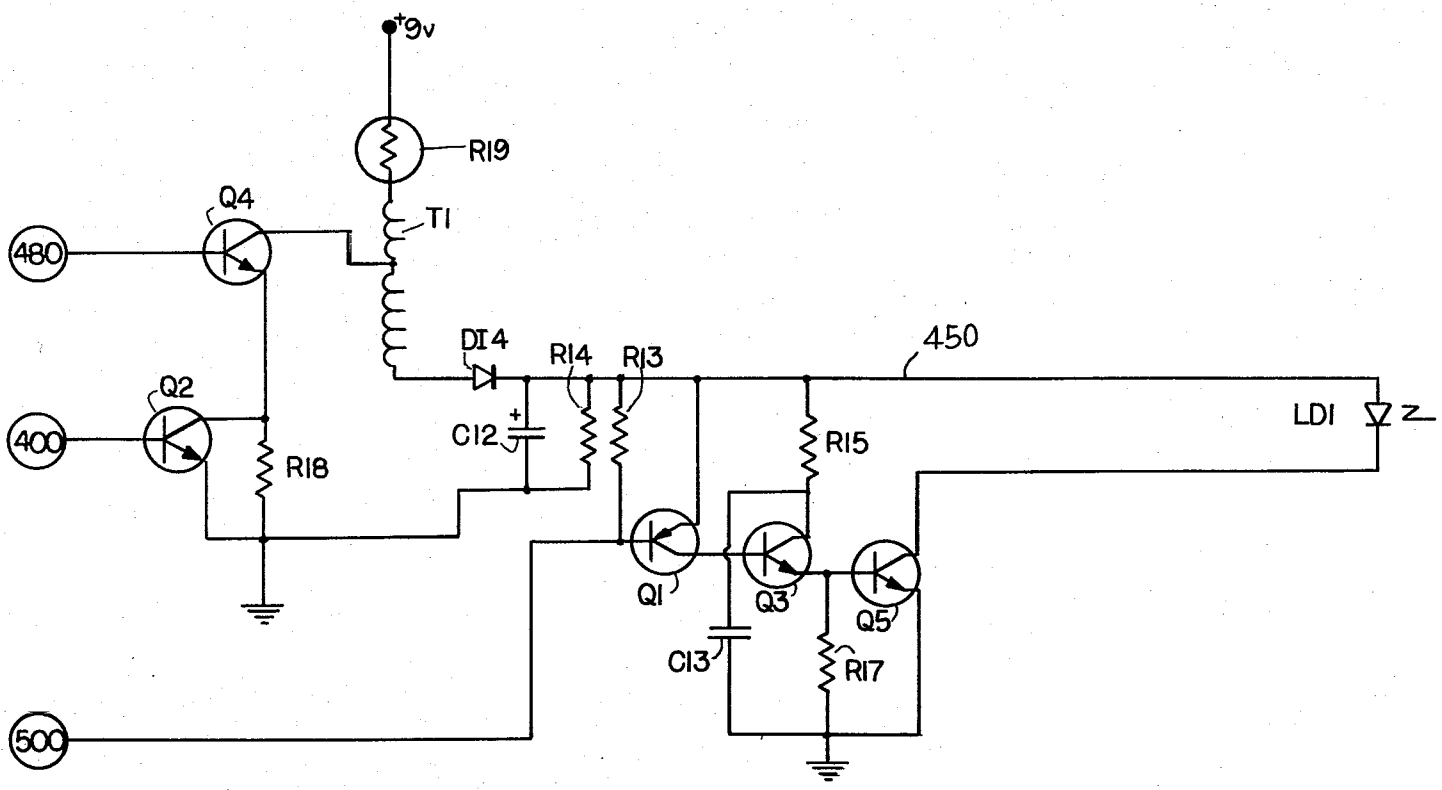
FIG. 5 is a circuit diagram of a circuit corresponding to the system of FIG. 4.

FIG. 5 is a circuit diagram of an operational circuit built according to the block diagram of FIG. 4. Integrated circuit Z20 is configured to act as an oscillator, the output of which is coupled to the clock input of flipflop Z21. The Q output of Z21 is coupled to the clock input of decade counter Z22 The inverse enable input of Z22 is tied to ground in order to enable the counting function of the integrated circuit.

Single-pole single-throw switch SW20 is tied to ground and makes contact with resistor R20 and capacitor C24 when the training weapon is triggered. Resistors R20 and R21 are connected to a fourteen volt source and resistor R21 is coupled in parallel with capacitor C24 to one input of NAND gate G20. The output of NAND gate G20 is coupled to one input of NAND gate G21 and the output of NAND gate G21 is coupled to the second input of gate G20. Thus, gates G20 and G21 comprise a set-reset flipflop with the set input being coupled to switch SW20. The output of gate G21 is coupled to the reset input of Z22.

A predetermined selection of the counter outputs C1 through C5 of decade counter Z22 are coupled through diodes in parallel to resistor R22 which is connected to ground. In the illustrated embodiment, outputs C1, C3 and C5 are coupled in parallel through diodes DI24, DI25 and DI26, respectively. Output C5 is also coupled through inverter G22 to the second input of G21. Thus, when all five outputs of Z22 have been polled, the set-reset flipflop formed by G20 and G21 is reset, thereby clearing all outputs of Z22 until switch SW20 is again closed.

The junction of the counter output diodes and R22 is also coupled to the input of inverter G23, and the output of inverter G23 is coupled through capacitor C22 to the base of transistor Q20. A fourteen volt source is also coupled through resistor R23 to the base of Q20. The emitter of Q20 is coupled directly to the fourteen volt source, and the collector of Q20 is coupled directly to the base of resistor Q21. The fourteen volt source is coupled through resistor R24 to the collector of Q21, and to intermediate return line 700. The emitter of Q21 is coupled directly to the base of transistor Q22 and through resistor R25 to intermediate return line 700. The fourteen volt source is coupled through laser diode LD2 to the collector of Q22, and the emitter of Q22 is coupled to line 700. Power supply capacitor C23 is also coupled between the fourteen volt source and line 700. The Q and inverted Q of outputs of flipflop Z21 are coupled through capacitors C21 and C20, respectively, to inputs of a full-wave rectifier bridge comprising diodes DI20, DI21, DI22 and DI23. The positive output of the bridge is grounded and the negative output of the bridge is coupled to line 700, thereby providing line 700 with a minus 14volt source. Thus, the total voltage across LD2 will be 28 volts. This amplifier circuit operates substantially as described above with respect to FIG. 3 with the exception that the power supplied to LD2 is not varied in the economy embodiment but rather is held constant.

Working models of the two embodiments described above have been constructed using the following component values. It should be noted, however, that these values are listed for the purposes of illustration and are not meant to limit the scope of the present invention. Those who are of average skill in the art will recognize that these values may be varied significantly without departing from the true scope of the invention.

Resistors

10M: R5
100K: R1, R2, R3, R4, R6, R14, R20, R21
10K: R13, R22, R23
820 ohm: R7
150 ohm: R15, R24
10 ohm: R18
1 ohm: R17, R25

Capacitors 0.05 mF: C12
0.01 mF: C2
0.12 mF: C13
27 pf: C1, C24, C22
1000 pf: C20, C21
2.5 uf: C23

All Diodes

1N914

Transistors

GE28: Q3, Q5, Q21, Q22
2N2907: Q1, Q20

Integrated Circuits

4071: G1
4093: G2, G3
4011: G5, G9, G6, G7, G8, G10, G11, G12, G13, G14, G17, G18, G19, G20, G21, G22, G23, G31
4024: Z7, Z4
RCA 3140: A1
4040: Z5
4027: Z2, Z21
4007: Z1, Z20
4017: Z22
4019: Z6
4512: Z10, Z11, Z12, Z13

FIG. 6 illustrates a typical laser diode body 250 and the optical output end 252 thereof. FIG. 7 illustrates in cross-section a cylindrical housing for the laser diode of FIG. 6 and appropriate optical elements. FIG. 8 shows the manner in which the laser diode body 250 is installed in the housing 254 with typical optical elements 256 and 258. The elements and the diode body may be fixed within the housing 254 by any well known conventional system.

FIG. 9 illustrates a handgun which has been modified in accordance with the present invention. A handgun 260 includes a hollow space 264 defined within butt 262. The space 264 is occupied by the logic circuitry and power supply of the present invention.

Connector sockets 274 and 276 are provided at the bottom of the butt 262 for connection of reset keys, dry-fire switches, battery rechargers, and other external devices as described above.

The barrel 268 of handgun 260 has been modified to include housing 254 at the end of barrel 268. Appropriate electrical connections (not shown) are made between the laser diode and the electronic components within space 264. The barrel 268 is vented with vents 266 in order to allow combustion gases from a discharged round to escape. Additionally, a block 270 is placed within barrel 268 between vents 266 and housing 254 to protect housing 254. Optical sensor housing 271 is mounted below housing 254 on the exterior of barrel 268.

Handgun 260 also includes a modified load cylinder 272, which is shown in partial cutaway in FIG. 10. The cylinder 272 includes a plurality of chambers 278 for holding rounds of ammunition. Each chamber is fitted with a blocking element 280, of sufficient exterior diameter to fit snugly within chambers 278 and of interior diameter sufficient to prevent the insertion of a live round 282 into a chamber 278. The length of a blocking element 280 is short enough to permit the insertion of a blank round (not shown) into a chamber 278. The exhaust gases from a fired blank round pass through the interior of blocking element 280 and barrel 268 to exit through vents 266.

Having disclosed a presently preferred embodiment and an alternate embodiment of the present invention, it is understood that changes may be made in the disclosed system without departing from the true spirit and scope of this invention as set forth in the following claims.

What is claimed is:

1. A laser weapons simulation and training system comprising a firearm, said firearm being capable of firing a load comprising a plurality of blank rounds; a data transmission system including in combination: sensor means, said sensor means being configured to detect when each of said rounds is fired; clock means, said clock means providing an output signal of constant frequency, said clock means being activated by said sensor means; first counter means, the output of said clock means being coupled to the input of said first counter means; data selector means, said data selector means having a plurality of selector inputs coupled to outputs of said first counter means, and having a plurality of single-bit data inputs, comprising a data word, said data inputs being selected for serial transmission by said data selector means, a portion of said data word of fixed value in order to indicate the identity of the system, and another portion of said data word being of variable value; data variance means, said data variance means having an input coupled to an output of said first counter means, said data variance means having at least one single-bit output coupled to at least one of said variable value inputs of said first data selector means, said data variance means varying said variable value inputs in order to provide an output signal from said first data selector means capable of distinguishing between a direct hit and a near miss when a round is fired; second counter means, the input of said second counter means being coupled to an output of said data variance means in order to count the number of rounds expended by operation of the system, an output of said second counter means being coupled to a reset input of said clock means in order to disable said clock means when said load is completely expended; gain controlled power amplifier means, said gain controlled power amplifier means having a data input and a power control input, said data input being coupled to said data output of said first data selector means, said power control input being coupled to an output of said data variance means for increasing the power of said gain controlled power amplifier means when said signal indicates a near miss; and modulated laser output means, said modulated laser output means being coupled to the output of said gain controlled power amplifier means for transmission of a data-modulated laser light signal; said modulated laser output means being mounted within a barrel of said firearm to project said laser light signal along the boresight of said firearm; and said data transmission system being mounted within said firearm.

2. The apparatus of claim 1 wherein said sensor means comprises:

an optical sensor means, said optical sensor means being adapted to detect the flash of light produced when a blank round is detonated; and accelerometer means, said accelerometer means being adapted to detect reaction motion of said weapon when a round is detonated;

said optical sensor means and said accelerometer means being coupled to said clock means to enable said clock means only when both said optical sensor means and said acceleromator means detect gunfire.

3. The apparatus of claim 1, including a first AND gate and detection means, said output of said clock means being coupled to said input of said first counter means through said first AND gate, a second input of said first AND gate being coupled to an output of said detection means, said detection means being adapted to disable said system in the event that a user of said system is struck by laser transmissions from a substantially identical system.

4. The apparatus of claim 3, wherein said detection means comprises a radio receiver.

5. The apparatus of claim 1, wherein said data variance means comprises in combination: third counter means, the input of said third counter means being coupled to an output of said first counter means so that said third counter means will count the number of transmissions of said plurality of data inputs of said first data selector means; second data selector means, the selector inputs of said second data selector means being coupled to at least a pair of outputs of said third counter means, said second data selector means having a plurality of selectable inputs, at least two of said inputs being alternately coupled by said second data selector means to at least one of said data inputs of said first data selector means in order to transmit a predetermined number of data words indicating a direct hit followed by a predetermined number of data words indicating a near miss.

6. The apparatus of claim 1, wherein an output of said data variance means is coupled to a gain control input of said gain controlled power amplifier means to increase the output level of said laser means during transmissions of data words indicating a near miss.

7. The apparatus of claim 1, including key switch means, said key switch means being adapted to reset said second counter means to compliment reloading of said weapon with blank rounds.

8. The apparatus of claim 1, including mode select switch means, said mode select switch means being adapted to couple the output of said first clock means to the input of said second counter means, said mode select switch means also being adapted to couple an output of said second counter means to said data input of said gain control power amplifier; said system further including connectable switch means for continuous output of said system in order to produce a boresight signal when said mode select switch means is operated to couple said first clock means to said second counter means, and said second counter means to said gain controlled power amplifier.

9. The apparatus of claim 1, wherein said laser means is located within the barrel of said weapon and includes battery means, said battery means providing power to said system and being located in the butt of said weapon.

10. A laser weapon simulation training system comprising a firearm weapon, said weapon being loadable with a plurality of blank rounds; sensor means, said sensor means being adapted to detect the trigger pull of said weapon; clock means connected to said weapon, said clock means being adapted to produce a signal of constant frequency, counter means, an input of said counter means being coupled to the output of said clock means; data selector means, said data selector means being adapted to repeatedly output a signal identifying said firearm weapon, the input of said data selector means being coupled to the output of said counter means; power amplifier means, the input of said power amplifier means being coupled to the output of said data selector means; and modulated laser light means, said modulated laser light means being coupled to the output of said power amplifier means.

11. Apparatus of claim 10 wherein said sensor means comprises a mechanical switch.

12. The apparatus of claim 10 including a set-reset flipflop, the set input of said set-reset flipflop being coupled to the output of said sensor means, the reset input of said set-reset flipflop being coupled to a high order output bit of said data selector means, and the output of said set-reset flipflop being coupled to the reset input of said counter means.

13. The apparatus of claim 10 wherein said counter means and said data selector means comprise: a decade counter, the input of said decade counter being coupled to the output of said clock means, said decade counter having a plurality of single-bit outputs, each of a predetermined portion of said outputs being coupled through a diode to an input of a multiple-input NOR gate.

14. A laser weapon simulation training system, said system including a firearm, said firearm including a barrel and handgrip each being adapted to enclose a plurality of components, said firearm being adapted to fire a plurality of blank rounds; sensor means, said sensor means being placed within said firearm and being adapted to detect the detonation of each said blank rounds by said firearm; variable data transmitter means, said variable data transmitter means being placed within said handgrip and being coupled to said sensor means so as to transmit a signal which varies from hit data to near miss data when each said blank rounds are detonated; power amplifier means, said power amplifier means being placed within said handgrip and being coupled to said variable data transmitter means so as to amplify said signal; and laser output means, said laser output means being placed within said barrel and aligned to project laser light along a major axis of said barrel, said laser output means being coupled to said power amplifier means so that said signal modulates said laser light.

15. A laser weapon simulation training system comprising a handgun including a barrel and handgrip, and being adapted to fire a plurality of blank rounds; sensor means comprising optical sensor means and accelerometer means, said optical sensor means being mounted on the exterior of said barrel and said accelerometer means being placed within said handgun, said sensor means being adapted to detect the detonation of each blank round fired by said handgun; variable data transmitter means placed within said handgrip coupled to said sensor means so as to transmit a signal beginning as hit data and changing to near miss data when each said blank rounds are detonated; power amplifier means placed within said handgrip coupled to said variable data transmitter means so as to amplify said signal; and laser means positioned within said barrel and aligned to project laser light along the longitudinal axis of said barrel, said laser means being coupled to said power amplifier means so that said signal modulates said laser light.

16. A laser weapon as claimed in claim 15, wherein said handgun is a pistol.

* * * * *